US006276437B1

(12) United States Patent
Den Hartog

(10) Patent No.: US 6,276,437 B1
(45) Date of Patent: Aug. 21, 2001

(54) METHOD AND APPARATUS FOR THE MANUFACTURE OF FORMABLE STEEL

(75) Inventor: Huibert Willem Den Hartog, Noordwijkerhout (NL)

(73) Assignee: Corus Staal BV, IJmuiden ( * ) Notice: Subject to any disclaimer, the term of this patent is extended or adjusted under 35 U.S.C. 154(b) by 0 days.

(21) Appl. No.: 09/091,516

(22) PCT Filed: Dec. 20, 1996

(86) PCT No.: PCT/EP96/05814

§ 371 Date: Oct. 2, 1998

§ 102(e) Date: Oct. 2, 1998

(87) PCT Pub. No.: WO97/23319

PCT Pub. Date: Jul. 3, 1997

(30) Foreign Application Priority Data

Dec. 22, 1995 (NL) ..... 1001976

(51) Int. Cl.[7] ..... B22D 11/10

(52) U.S. Cl. ..... 164/488; 164/476; 164/437; 164/335; 164/337; 164/133

(58) Field of Search ..... 164/488, 476, 164/437, 335, 336, 337, 133, 442

(56) References Cited

U.S. PATENT DOCUMENTS 4,739,972 * 4/1988 Podrini ..... 164/488
5,329,688 * 7/1994 Arvedi et al. ..... 164/442
5,361,825 * 11/1994 Lax et al. ..... 164/437
5,716,538 * 2/1998 Poloni et al. ..... 164/437
5,716,838 * 2/1998 Poloni et al. ..... 164/437

FOREIGN PATENT DOCUMENTS 2675411 10/1992 (FR) .
58-035051 * 3/1983 (JP) .
58-038645 3/1983 (JP) .
58-38645 3/1983 (JP) .
60-021167 * 2/1985 (JP) .
61-095756 * 5/1986 (JP) .
1-284476 11/1989 (JP) .
9200815 1/1992 (WO) .

OTHER PUBLICATIONS

Abstract and a Figure of JP1284476, Nov. 15, 1989.
Office Action, Sep. 22, 2000, in Korean application 704893/1998 corresponding to US Ser. No. 09/091,516.

* cited by examiner

*Primary Examiner*—Nam Nguyen
*Assistant Examiner*—I.-H. Lin
(74) *Attorney, Agent, or Firm*—Stevens, Davis, Miller & Mosher, LLP

(57) ABSTRACT

Continuous casting machine for the casting of a thin slab with a thickness of less than 150 mm comprising a vacuum tundish having a first atmospheric chamber (7) and a second low pressure or vacuum chamber (1) hydraulically connected to the first chamber and purging means (11) for introducing a purging gas into the liquid steel after it has entered the first chamber but before it entered the second chamber.

21 Claims, 2 Drawing Sheets

METHOD AND APPARATUS FOR THE MANUFACTURE OF FORMABLE STEEL

CROSS-REFERENCE TO RELATED APPLICATION

This application is a 371 of PCT/EP 96/05814 filed on Dec. 20, 1996.

FIELD OF THE INVENTION

The invention relates to a method for the manufacture of formable steel strip comprising the steps of forming in the mould of a continuous casting machine liquid steel into a thin slab having a thickness of less than 150 mm homogenizing in a homogenizing furnace and rolling the slab in the austenitic region using the casting heat to obtain an intermediate slab using the casting heat, if desired cooling the intermediate slab to a temperature where a substantial portion of the steel is transformed into the ferritic region, and rolling said intermediate slab to the strip either in the austenitic or ferritic region.

BACKGROUND OF THE INVENTION

Such method is disclosed in EP-A-0541754. The method has particular advantages because it can be performed in a continuous or seni-continuous manner leading among other things to a better material efficiency and a more efficient use of the equipment. However, an important disadvantage of the method is that until now it is until now not well suited for the manufacture of high quality steel such as interstitial free steel or other formable steel with high surface quality and high degree of freedom of internal defects. The source of most of these problems are the processes in the mould of the continuous casting machine. The processes are particularly complex due to the high width to thickness ratio of the mould and the high casting speed, in the region of 6 m/min leading to vigorous flows in the mould.

Another embodiment of a prior art method is disclosed in EP-A-0666122. The proposed method therein comprises the steps of continuous casting of a thin slab, homogenizing the slab in a reheating furnace and subsequently rolling the slab in the austenitic region to a desired final thickness of e.g. 2 mm.

Still another embodiment of a prior art method is disclosed in FR-A-2675411. The proposed apparatus therein consists of a tun dish for the continuous casting of a molten metal, more especially steel, which is used between a ladle and a mould. It is characterized by the presence of a lower chamber, which is fed from the ladle, and a higher chamber which chambers are connected by an inclined tunnel. Means are provided for evacuating the atmosphere in the higher chamber.

SUMMARY OF THE INVENTION

An object of the present invention is to provide a method with which it is possible to manufacture in a continuous or semi-continuous manner high quality formable steel strip starting from a thin cast slab.

This object is achieved with a method that, according to the invention is characterized in that the liquid steel is fed from a ladle into a first atmospheric chamber of a vacuum tun dish also comprising a second chamber hydraulically connected by a conduit to the first chamber in which second chamber a low pressure is preserved and the steel is conveyed from the second, low pressure or vacuum chamber, through an exit port therein into the mould.

The invention is particularly suitable for use in such methods as are described in among others EP-0306076, EP-0329220, EP-0370575, EP-0504999, EP-0541574, NL-1000693, NL-1000694 and NL-1000696, the contents of which are considered to be incorporated in this description by this reference.

It is known to cast steel into thin slabs, thinner than 150 mm, and preferably thinner than 100 mm in order to limit subsequent processing stages. Up to now the quality achieved by casting thin slabs has been low. In particular the steel is susceptible to ageing, has moderate to poor forming properties and is ridden with inclusions. These and other problems are described in the publication New Steel, May 1994, page 22 et seq.

The invention breaks with the deep rooted prejudice that high quality thin-cast steel cannot be manufactured economically. Advantages of the method are further elaborated and explained in the following.

When using an atmospheric tundish for casting thin slabs with a thickness smaller than 150 mm, more usually with a thickness between 40 and 100 mm, the flow rate of the steel through an entry nozzle from the tundish to the mould is high because of the high casting rate such as 6 m/min. A ratio of 1:100 in these two rates is not exceptionally high. The high entry rate into the mould in the known method causes turbulences whereby molten steel is driven up along the narrow sidewalls of the mould. This makes the meniscus of the molten steel higher on the narrow sidewalls of the mould than in the middle. The meniscus is covered with a layer of molten casting powder. Molten steel being driven up causes the casting powder to flow to the lowest point, i.e. around the middle part of the mould. As a result, the effect of the casting powder on the heat transfer from the thin slab to the surroundings and to the cooled walls of the mould is not equal around the circumference of the mould.

This leads to increased oxide growth in places with higher than desired temperatures and to increased deformation resistance in those places of the thin slab with lower temperature. The thin slab then displays surface defects and shape deviations both of which can no longer be remedied during subsequent processing of the thin slab, in particular in the case of continuous or semi-continuous processes, whereby the steel thin slab is rolled out from the casting heat.

The effects of driving up and also asymmetry occur to a great extent in a tundish for casting thin slabs. With the method in accordance with the invention it is possible to control better any turbulences occurring and asymmetry and instability of the flow in the mould no longer occurs. Consequently it is possible to control better the shape and quality of the cast thin slab and the strip manufactured from it.

For constructional reasons it is sometimes desirable to design the mould in a curved shape joining the radius of curvature of the roller table of the thin slab continuous casting machine. With the method and apparatus in accordance with the invention it is possible to use a submerged nozzle curved to match the curved shape of the mould in the case of such a machine.

The submerged entry nozzle used in combination with a vacuum tundish is no longer bound to strict limits either on shape or on dimensions. Both the entry opening and the exit opening of the entry nozzle can have a desired shape better adapted to their purpose. There is also a high degree of freedom of choice in terms of shape and dimensions of the internal cross-section of the body of the submerged nozzle i.e. that part running between the two openings.

As described the impulse of flow of molten steel from the conventional submerged nozzles causes a depression in the meniscus. In order to reduce the magnitude of the depression a preferred embodiment of the method in accordance with the invention is characterized in that the liquid steel is conveyed from the second chamber to the mould through an entry nozzle with an internal cross-sectional area of more than 5% and preferably of more than 10% of the cross-sectional area of the mould.

In the case of casting thin slabs thinner than 150 mm the conventional casting rate, i.e. the rate at which the slab leaves the mould, is approximately 6 m/min. In accordance with this embodiment of the invention the exit rate of the molten steel from the submerged nozzle is less than 100 m/min. The greater freedom of choice in the dimensions of the submerged nozzle even makes it possible to make the exit opening of the submerged nozzle greater than 10% of the cross-section of the mould, and consequently further reduce the impulse of flow. It has been found possible to achieve a virtually flat meniscus.

A very important advantage of the possibility to choose the size of the entry opening and the exit opening of the submerged nozzle within broad limits is the possibility of increasing the casting rate for casting thin slab of continuous casting machines and consequently increasing the production capacity. The outflow opening as well as the body may be made smaller while retaining the shape to match the shape of the mould used so that the contour of the outflow opening and possibly of the body follows the contour of the mould. The shapes are then conform.

As the cross-section of the exit opening of the entry nozzle is increased the impulse of flow decreases and consequently the flow rate of the steel close to the meniscus decreases. The flow rate can then become so low that insufficient heat is supplied by the flowing steel for maintaining the meniscus in molten state. It is therefore preferable that the liquid steel is conveyed from the second chamber to the mould through an entry nozzle with an internal cross-sectional area of less than 30% of the cross-sectional area of the mould. With this embodiment of the invention this effect of solidifying meniscus does not occur.

Additionally the flow of the steel can be influenced with another embodiment of the method in accordance with the invention which is characterized in that the flow of the steel entering the second chamber is braked or deflected away from the exit port of the second chamber.

One way of braking the flow is by electromagnetically influencing the flow in the second chamber in the form of an electromagnetic brake. The electromagnetic brake may be used to influence the flow rate of the molten steel locally.

It is also possible to use an electromagnetic brake to influence the flow in the mould. In that embodiment the electromagnetic brake gives a still greater freedom of choice in the dimensions of the casting nozzle and the possibility of controlling the flow.

Ageing susceptibility of steel is caused by non-bound carbon or nitrogen. A known way of binding these elements is to add titanium to the molten steel so that titanium nitrides and, with sufficient titanium added, also titanium carbides occur. In addition titanium carbides, especially in combination with vacuum decarbonisation, have a favourable effect on the formability of a steel strip manufactured from the steel slab. Technologically and economically, steel containing titanium is a high quality steel grade with a wide range of applications.

A drawback of steel containing titanium is that it is especially susceptible to inclusions and the occurrence of clogging in the submerged entry nozzle. This effect is even stronger in casting thin slabs whereby submerged entry nozzles with narrow passages are used. Therefore steel containing titanium is not continuously cast into thin slabs on any practical scale. As will be shown the invention makes it possible to reduce greatly the number of inclusions in steel containing titanium and to cast the steel without any great risk of the submerged nozzle clogging. Consequently the invention has opened the way to manufacturing a technologically and economically high quality steel grade with a higher yield and at a lower cost price.

A problem with the known method for the continuous casting of steel in particular casting thin slabs of steel is that the submerged entry nozzle can become clogged. This effect occurs in particular in titanium containing or other interstitial free steel.

Steel for continuous casting is so-called killed steel in which oxygen combines into aluminium oxide by aluminium supplied for that purpose. Part of the aluminium oxide separates and goes into a slag layer floating on the molten steel and the other part stays behind in the molten steel. Because inclusions in the steel end product are undesired the steel is rinsed with argon as rinsing gas. In the state of the art the argon is conveyed into the steel at the entry opening of the submerged entry nozzle. As it rises in the mould the argon takes along with it aluminium oxide from the molten steel. It happens that an aluminium oxide particle comes into contact with the inner wall of the submerged nozzle and sets there. Because of the mutual affinity of the aluminium oxide particles the deposit grows and ultimately causes clogging in the submerged nozzle. It is not possible to predict where clogging is occurring in the submerged entry nozzle and it depends on chance. With the apparatus in accordance with the invention it is possible to choose a submerged nozzle with a larger cross-section than is possible in the state of the art. A submerged nozzle with a larger cross-section is less susceptible to clogging. The flow rates in a submerged nozzle of larger cross-section are also smaller so that any growth has a smaller disadvantageous effect. The invention gives a solution to the problem of clogging. These attainable advantages are of particular importance in case of a method for casting thin slabs because an entry nozzle with a small dimension in the one direction must be used in it due to the limited space in the mould. The submerged entry nozzle used in the method according to the invention can have a large cross-sectional area and consequently still not be susceptible to clogging.

The known technique for rinsing the molten steel with a rinsing gas such as argon introduced near the entry port of the entry nozzle in order to expel aluminium oxide is less effective in the state of the art of casting thin slabs because the argon bubbles have too little space in the mould to rise up quickly. Large argon bubbles then occur which have a distorting effect on the meniscus. These problems can be avoided with an embodiment of the invention which is characterized in that a purging gas is introduced into the liquid steel after it leaves the ladle and before it enters the second chamber. An additional advantage is that very few or no argon bubbles or inclusions stay behind in the cast thin slab. A further advantage can be achieved with a method which is characterized in that the conduit comprises valve means and the purging gas is introduced at or immediately upstream of the valve means.

This achieves the advantage that because of the high velocity of the steel and the consequent reduced pressure gives rise to a larger number of bubbles the argon that rises up carrying with them the inclusions. This method of introducing argon is also applicable for casting thick slabs whereby the advantage is achieved that the argon has a better yield while the number of included argon bubbles or other inclusions in the cast slab is less.

The method in accordance with the invention makes it possible to choose a submerged entry nozzle with a larger cross-section than the known submerged entry nozzles so that the previously described effect of clogging no longer occurs or is at least considerably reduced. The method in accordance with the invention has opened the way to casting a clean, non aging-susceptible steel in a continuous casting machine for casting thin slabs.

Preferably in case alloying elements should be added to the steel, these alloying elements are introduced in the steel after the steel has left the first chamber. Since behind the first chamber the space is essentially free of oxygen or other chemically active gasses, the yield of the alloying elements is high. Further, due to the homogeneous flow in the second chamber, the alloying elements are spread homogeneously and do not precipitate. To obtain a good mixing of the alloying elements and the steel it is preferred that the alloying elements are introduced near or at the conduit between the two chambers, preferably near or at the valve means when present.

Particular advantages, especially with regard to material yield, simplicity of equipment and energy consumption may be achieved with a method which is characterized in accordance with the invention in that the cast thin slab is homogenized while making use of the casting heat and reduced in thickness in the austenitic region. A further advantage may be achieved with a method which is characterized in accordance with the invention in that the slab may be rolled in the ferritic region above 250° C., whether or not following reduction in the austenitic range while making use of the casting heat. This method produces a steel strip with the properties of a cold rolled strip while retaining the advantages just named.

The invention is also embodied in a continuous casting machine for the casting of a thin slab with a thickness of less than 150 mm.

The invention embodied in the apparatus is particularly suited to being used in combination with a continuous or semi-continuous apparatus or method as described in EP-0306076, EP-0329220, EP-0370575, EP-0504999, EP-0541574, NL-1000693, NL-1000694 and NL-1000696, the contents of which are considered to be incorporated in this description by this reference.

A problem with the known apparatus is that it is not particularly suited for the manufacture of high quality formable steel plate or strip. An object of the invention is to provide a continuous casting machine that obviates the problems encountered with the state of the art apparatus when manufacturing higher quality formable steel plate or strip.

This object is attained with a continuous casting machine that is, according to the invention characterized by a vacuum tundish having a first atmospheric chamber and a second, low pressure or vacuum, chamber hydraulically connected to the first chamber and purging means for introducing a purging gas into the liquid steel after it has entered the first chamber but before it entered the second chamber.

The vacuum tundish provides the possibility of a low entry velocity of the liquid steel into the mould because the cross-sectional area of the entry nozzle can be chosen large.

A further reduction of the problem of inclusion and surface defects is also possible with an embodiment of the invention which is characterized in that means of purging are provided for conveying rinsing gas into the molten steel before the molten steel flows into the second chamber. This has the advantage that the rinsing gas, such as argon, taking aluminium oxide along with it, is able to separate in the vacuum tundish where the steel stays long enough at sufficiently high temperature and a clean, inclusion-free or low-inclusion steel is obtained.

A further improvement of the argon's expelling effect is achieved with an embodiment of the invention which is characterized in that a conduit between the first chamber and the second chamber for hydraulically connecting said chamber which conduit is provided with valve means for regulating the flow of liquid steel and that the purging means are operative in the vicinity or at the valve means. Passage through the inlet organ creates a pressure reduction thereby enabling many more argon bubbles to be generated. Particles of aluminium oxide carried along by the argon bubbles go back into the slag layer floating on the steel bath in the vacuum tundish. This achieves an improved expulsion of inclusions or gas bubbles.

A simple and effective embodiment for introducing the purging gas is characterized in that the valve means comprise a seat and a controlling rod cooperating with the seat which controlling rod is provided with a central bore ending in a purging block that is porous for the purging gas.

The purging effect of the purging gas is enhanced because of the lower pressure near the valve means leads to more bubbles and therefore to a higher purging effect.

In order to prevent unwanted eddies or turbulences in the mould, a homogeneous flow in the entry nozzle is pursued.

A preferred embodiment of the continuous casting machine according to the invention for reaching this objective is characterized in that the second chamber has means for braking or deflecting the flow of steel entering the second chamber.

A simple and passive embodiment that does not require external controlling is characterized in that the means for deflecting comprise a baffle situated between the entry port through which the liquid steel enters the second chamber and the exit port through which the liquid steel leaves the second chamber.

A stable good shape of the meniscus in the mould can be achieved with an embodiment of the invention that is characterized in that the second chamber is provided with an entry nozzle of a cross-sectional area of not less than 5%, preferably not less than 10% of the cross-sectional area of the mould.

In order to prevent a too high cooling or even freezing of the meniscus a further embodiment is characterized in that the second chamber is provided with an entry nozzle of a cross-sectional area of less than 30% of the cross-sectional area of the mould.

An improvement of the distribution of the liquid steel flowing through the entry nozzle into the mould can be achieved by an embodiment that is characterized in that the cross-section of the entry nozzle conforms to the cross-section of the mould.

The advantages as described herein in relation to certain embodiments of the method according to the invention are equally applicable to the various embodiments of the apparatus according to the inventions in which means for performing such embodiments of the method are incorporated and vice versa. Further it will be clear to the skilled person that the subject matter of the present invention is equally applicable to conventional casting with the same advantages as described in relation to thin slab casting.

The invention is further embodied in an apparatus for the manufacture of formable steel strip comprising a homogenizing furnace a rolling mill for rolling in the austenitic region of the steel, optionally a rolling mill for rolling in the ferritic region, optionally cooling means for cooling the steel from the austenitic region to the ferritic region, optionally cooling means for cooling the steel after rolling in the ferritic region, optionally a coiler for coiling the strip and a continuous casting machine.

It will be clear to the expert that the apparatus and the method in accordance with the invention, although described for application on steel, may also be used to advantage in casting other metals. Consequently the invention is not limited to its use in casting steel.

BRIEF DESCRIPTION OF THE DRAWINGS

The invention will now be described in the following by reference to the drawing of non-limitative example embodiments.

DETAILED DESCRIPTION OF THE PREFERRED EMBODIMENTS

Figure 1:
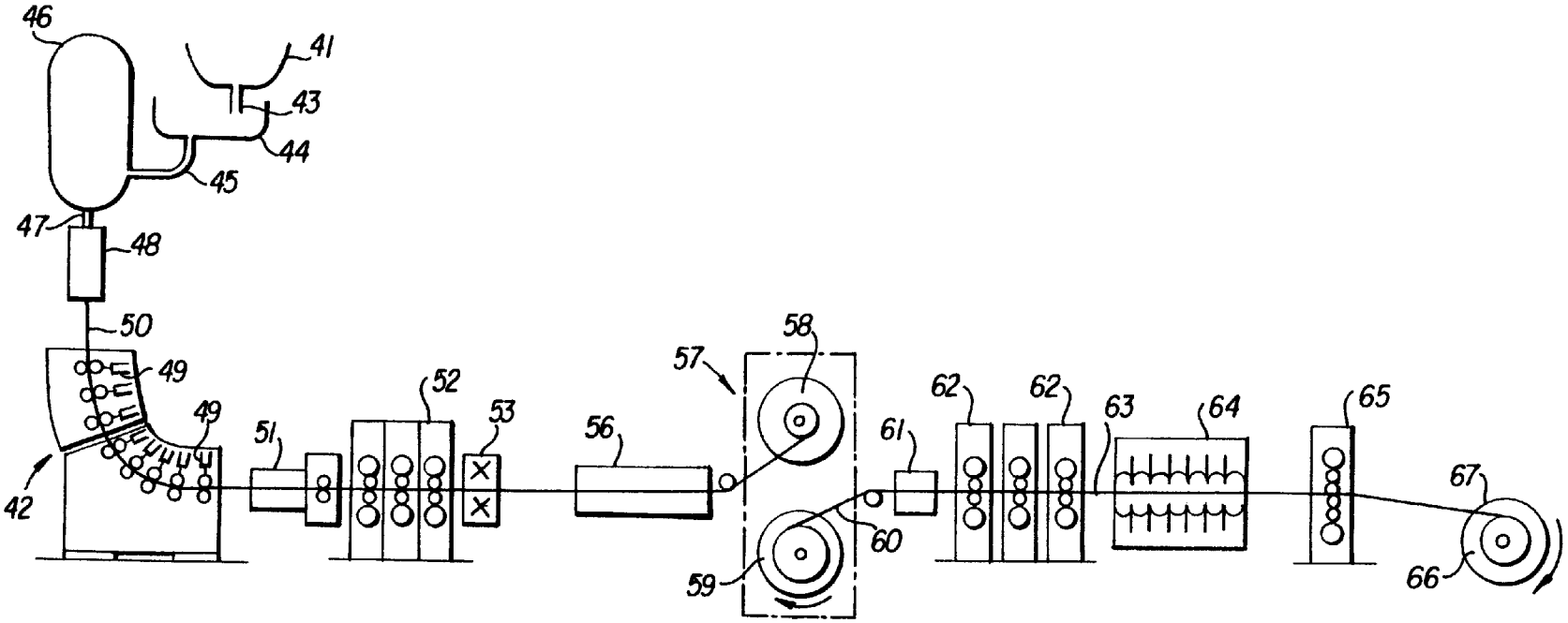
FIG. 1 a schematic view of a continuously or semi-continuously operating apparatus making use of the invention for the manufacture of a steel strip with cold-rolled strip properties and FIG. 2 a schematic cross-section of a vacuum tundish and surrounding installation parts of a continuous casting machine.

In FIG. 1 a ladle (41) brings molten steel from a steel plant to a continuous casting machine (42) for casting thin slabs. Molten steel flows through the immersion nozzle (43) in the vacuum tundish having a first chamber (44), From the first chamber (44) the steel flows through the coupling pipe or conduit (45) to the second, vacuum chamber (46). The molten steel goes via submerged entry nozzle (47) into the mould (48). Steel, at least partially solidified, leaves the mould (48) at the bottom in the form of a thin slab (50) with a thickness smaller than 150 mm, preferably with a thickness of between 40 and 100 mm.

In the roller table the thin slab (50) is turned from a vertical position to a horizontal position and if desired somewhat reduced in thickness. After having the oxide layer removed in a scale breaker (51) the thin strip (50) enters mill stand (52). The thin slab is reduced in thickness in it to an exit thickness of approximately 20 mm.

Shears (53) are used to cut off the head and tail pieces from the thin slab reduced in thickness to a strip (55) or strip (55) may be cut into pieces of desired length. Strip (55) then runs through a homogenising furnace for temperature homogenisation and any increasing in temperature. Mill stand (52) and homogenising furnace (56) may be interchanged in relative position. For further temperature homogenisation and, if so desired, to be able to select the rolling speed, the strip (55) is stored temporarily in a coil furnace (57) arranged in such a way that the one reel (58) can wind up while another reel (59) can unwind. Having again had the oxide scale removed in scale breaker (61), the unwound strip (60) is rolled in rolling apparatus (62). On exiting rolling apparatus (62) the strip (63) has a thickness of for example 2.0 mm. In the cooling apparatus (64) the strip (63) is cooled to the ferritic range from the austenitic range in which the steel was processed up to then. In the rolling apparatus the strip is rolled to a final thickness of between 0.5 and 1.5 mm and then wound into a wound coil (66). The strip rolled in the ferritic range has the properties of a cold-rolled strip and is manufactured in a continuous or semi-continuous process starting with molten steel. The use of a vacuum tundish makes it possible to produce a strip with better properties than has been possible until now, in particular with regard to surface quality, shape and absence of inclusions in low carbon steel.

Figure 2:
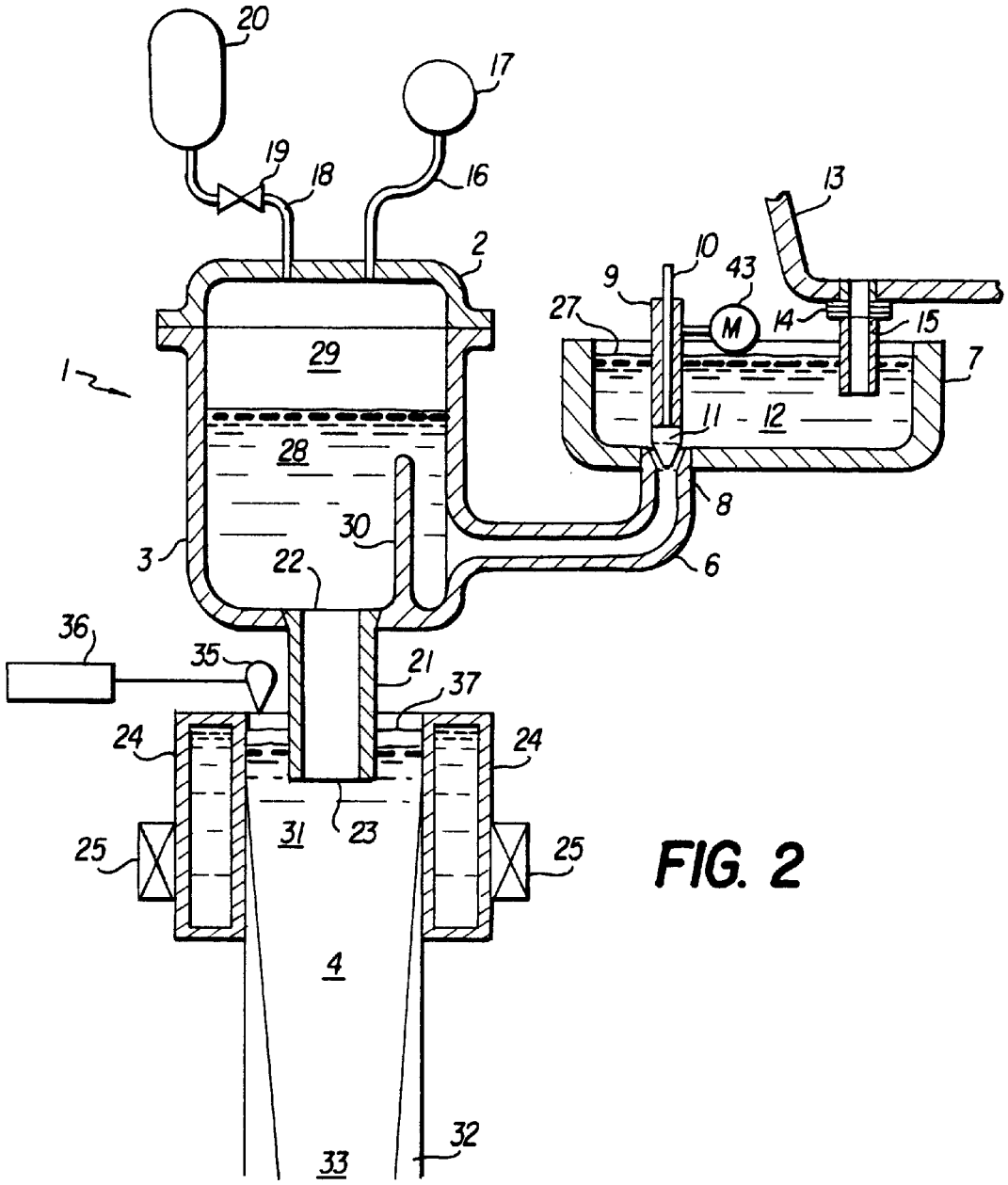

In FIG. 2 the top of a second chamber (1) of the vacuum tundish is provided with a cover (2) attached gas-tight to the vessel (3) of the second chamber. The vessel (3) is coupled to the first atmospheric chamber (7) by means of a coupling pipe or conduit (6). The coupling pipe opens out in the first chamber (7) through a cup (8). A regulator rod (9) fits into the cup and is provided with a central bore (10) which ends in a purging plug (11) at the bottom of the regulator rod. The purging plug (11) is shaped to match the cup (8) and together with it forms a regulator organ or valve for admitting molten steel (12) from the first chamber (7) to vessel (3) in a controllable quantity. Suspended above the storage vessel (7) is a ladle (13) (partially drawn) which is provided at the bottom with an immersion nozzle (15) capable of being closed with a slide gate (14). A pipe (16) extends through cover (2) and is coupled to a vacuum pump (17). Also extending through cover (2) is a gas line (18) which, with the aid of regulating valve (19), is coupled to a purging supply apparatus (20). A submerged entry nozzle (21) extends into the bottom of vessel (3) with an entry opening (22) which is connected to the interior of the vessel (3), and an exit opening (23). The submerged entry nozzle (21) extends into the mould (24). The embodiment of the entry nozzle (21) shown in FIG. 2 is a simple hollow conduit of constant diameter. An electromagnetic brake (25) is placed around the mould. Steel from ladle (13) flows through the opened slide gate (14) through submerged nozzle (15) into the first chamber (7). A layer of slag (27) lies on the molten steel (12) in the first chamber (7) in order to screen off the steel thermally and chemically from the surrounding atmosphere. Steel flows past the regulator organ formed by the cup (8) and the regulator rod (9) in a quantity controllable by the vertical position of the regulator rod (9) through the coupling pipe (6) to the second chamber (1). The position of the regulator rod and therefore the quantity of steel admitted can be controlled or regulated on the basis of the measurement of the level of the molten steel in mould (24). The level is measured with a sensor (35) which is coupled to the input of measuring and/or regulating apparatus (36). The output of the measuring and/or regulating apparatus (36) is connected (not indicated in detail) to a driving organ (43) so that it is able to steer it and can influence the position of the regulating rod. The advantage of such an arrangement is that the level of the molten steel can be well controlled and is not disturbed or only slightly disturbed by gas such as argon purging gas that is released above the steel bath in the space (29) in the vacuum tundish. Argon gas is conveyed to the purging plug (11) through bore (10) from a storage vessel (not drawn). The argon gas passes through the purging plug and is absorbed in and carried along by the molten steel passing the regulating rod (9). The argon gas rises in the second chamber (1) out of the molten steel (28) and goes into the space (29) above the molten steel from where it is drawn off by the vacuum pump (17). By controlling the regulating valve (19) an adjustable quantity of gas is admitted from gas supply apparatus (20) to the space (29) in order to set and maintain a desired gas pressure in it. A wall (30) is positioned in the second chamber to deflect the molten steel flowing through coupling pipe (6) away from the steel (28) now lying at rest in the other part of the second chamber. The wall (30) also provides the advantage that argon carried along forms many small gas bubbles. The gas bubbles can rise quickly and the flow forced upward by the wall conveys them along the surface of the molten steel in the second chamber where, carrying the impurities along with them, they are absorbed into the slag layer.

The gas pressure in space (29) may be used to control the quantity of steel which flows via entry opening (22) and exit opening (23) of submerged entry nozzle (21) to the mould (24). A layer of casting powder (37) lies on the molten steel (31). The electromagnetic brake (25) can be used to influence the behaviour of the molten steel, in particular the flow. The steel, partly provided with a solidified wall (32) leaves the mould as slab (33).

What is claimed is:

1. A method for the manufacture of formable steel strip comprising the steps of:

forming in a mould of a continuous casting machine liquid steel into a thin slab having a thickness of less than 150 mm, homogenizing in a homogenizing furnace and rolling the slab in the austenitic region using the casting heat to obtain an intermediate slab using the casting heat, optionally cooling the intermediate slab to a temperature where a substantial portion of the steel is transformed into the ferritic region, and rolling said intermediate slab to the strip either in the austenitic or ferritic region, wherein the liquid steel is fed from a ladle into a first atmospheric chamber of a vacuum tundish also comprising a second chamber hydraulically connected by a conduit to the first chamber in which second chamber a low pressure is preserved, the steel passes from the first chamber to the second chamber, and the steel is conveyed from the second, low pressure or vacuum chamber, through an exit port therein into the mould, the conduit comprising a valve means;

introducing a purging gas via purging means into the liquid steel after the steel has entered the first chamber but before the steel entered the second chamber, and employing the valve to regulate the passing of the liquid steel through the conduit between the first chamber and the second chamber, and wherein the purging means is operated in the vicinity of, or at, the valve means, and introduces the purging gas for rinsing the liquid steel.

2. A method according to claim 1, wherein the liquid steel is conveyed from the second chamber to the mould through an entry nozzle with an internal cross-sectional area of more than 5% of the cross-sectional area of the mould.

3. The method according to claim 1, wherein the liquid steel is conveyed from the second chamber to the mould through an entry nozzle with an internal cross-sectional area of less than 30% of the cross-sectional area of the mould.

4. The method according to claim 1, wherein a purging gas is introduced into the liquid steel after it leaves the ladle and before it enters the second chamber.

5. The method according to claim 4, wherein the conduit comprises valve means and the purging gas is introduced at or immediately upstream of the valve means.

6. The method according to claim 1, wherein alloying elements are introduced into the steel in the second chamber.

7. The method according to claim 1, wherein the flow of the steel entering the second chamber is braked or deflected away from the exit port of the second chamber.

8. The method according to claim 1, wherein the liquid steel is conveyed from the second chamber to the mould through the entry nozzle wherein the internal cross-sectional area of the entry nozzle is more than 10% of the cross-sectional area of the mould.

9. A continuous casting machine for the casting of a thin slab with a thickness of less than 150 mm, comprising:

a vacuum tundish having:

a first atmospheric chamber, a second, low pressure or vacuum, chamber hydraulically connected to the first chamber, purging means for introducing a purging gas into the liquid steel after the steel has entered the first chamber but before the steel entered the second chamber, and a conduit between the first chamber and the second chamber for hydraulically connecting said chambers, the conduit comprising valve means for regulating the flow of the liquid steel, and wherein the purging means are located to operate in the vicinity of, or at, the valve means, and are for introducing the purging gas for rinsing the liquid steel.

10. The continuous casting machine according to claim 9, wherein the valve means comprise a seat and a controlling rod cooperating with the seat which controlling rod is provided with a central bore ending in a purging block that is porous for the purging gas.

11. The continuous casting machine according to claim 8, wherein the second chamber is provided with an entry nozzle of a cross-sectional area of not less than 10% of the cross-sectional area of the mould.

12. The continuous casting machine according to claim 9, wherein the second chamber is provided with an entry nozzle, to convey molten steel from the second chamber to the mould, of a cross-sectional area of not less than 10% of the cross-sectional area of the mould.

13. The machine of claim 9, further comprising a thin film slab casting mould, wherein the second chamber has an entry nozzle in functional communication with the thin film slab casting mould.

14. The continuous casting machine according to claim 9, wherein the second chamber has means for braking or deflecting the flow of steel entering the second chamber.

15. The continuous casting machine according to claim 14, wherein the means for deflecting comprise a baffle situated between the entry port through which the liquid steel enters the second chamber and the exit port through which the liquid steel leaves the second chamber.

16. The continuous casting machine according to claim 9, wherein the second chamber is provided with an entry nozzle of a cross-sectional area of not less than 5% of the cross-sectional area of the mould.

17. The continuous casting machine according to claim 16 wherein the cross-section of the entry nozzle conforms to the cross-section of the mould.

18. The continuous casting machine according to claim 9, wherein the second chamber is provided with an entry nozzle of a cross-sectional area of less than 30% of the cross-sectional area of the mould.

19. The continuous casting machine according to claim 18, wherein the cross-section of the entry nozzle conforms to the cross-section of the mould.

20. The machine of claim 18, wherein the ratio is of the area of a discharge end of the entry nozzle to the area of the mould.

21. The machine of claim 18, wherein the entry nozzle is a hollow conduit.

* * * * *